US008301440B2

(12) United States Patent
Zopf et al.

(10) Patent No.: US 8,301,440 B2
(45) Date of Patent: Oct. 30, 2012

(54) BIT ERROR CONCEALMENT FOR AUDIO CODING SYSTEMS

(75) Inventors: Robert W. Zopf, Rancho Santa Margarita, CA (US); Vivek Kumar, San Jose, CA (US); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 808 days.

(21) Appl. No.: 12/431,155

(22) Filed: Apr. 28, 2009

(65) Prior Publication Data

US 2009/0281797 A1 Nov. 12, 2009

Related U.S. Application Data

(60) Provisional application No. 61/051,981, filed on May 9, 2008.

(51) Int. Cl.
*G10L 21/02* (2006.01)
*G10L 19/00* (2006.01)

(52) U.S. Cl. ..... 704/228; 704/501

(58) Field of Classification Search ..... None
See application file for complete search history.

(56) References Cited

U.S. PATENT DOCUMENTS

| | | | | |
|---|---|---|---|---|
| 4,710,960 | A * | 12/1987 | Sato | 704/219 |
| 6,885,988 | B2 * | 4/2005 | Chen | 704/228 |
| 6,914,940 | B2 * | 7/2005 | Tanaka et al. | 375/254 |
| 7,302,385 | B2 * | 11/2007 | Sung et al. | 704/219 |
| 7,321,559 | B2 * | 1/2008 | Etter et al. | 370/242 |
| 2002/0035468 | A1 * | 3/2002 | Taori | 704/207 |
| 2003/0163304 | A1 * | 8/2003 | Mekuria et al. | 704/207 |
| 2009/0006084 | A1 | 1/2009 | Chen | |

* cited by examiner

*Primary Examiner* — Brian Albertalli
(74) *Attorney, Agent, or Firm* — Fiala & Weaver P.L.L.C.

(57) ABSTRACT

A bit error concealment (BEC) system and method is described herein that detects and conceals the presence of click-like artifacts in an audio signal caused by bit errors introduced during transmission of the audio signal within an audio communications system. A particular embodiment of the present invention utilizes a low-complexity design that introduces no added delay and that is particularly well-suited for applications such as Bluetooth® wireless audio devices which have low cost and low power dissipation requirements.

28 Claims, 7 Drawing Sheets

BIT ERROR CONCEALMENT FOR AUDIO CODING SYSTEMS

CROSS-REFERENCE TO RELATED APPLICATIONS

This application claims priority to U.S. Provisional Patent Application No. 61/051,981, filed May 9, 2008, the entirety of which is incorporated by reference herein.

BACKGROUND OF THE INVENTION

1. Field of the Invention

The invention generally relates to systems and methods for improving the quality of an audio signal transmitted within an audio communications system.

2. Background

In audio coding (sometimes called "audio compression"), a coder encodes an input audio signal into a digital bit stream for transmission. A decoder decodes the bit stream into an output audio signal. The combination of the coder and the decoder is called a codec. The transmitted bit stream is usually partitioned into frames, and in packet transmission networks, each transmitted packet may contain one or more frames of a compressed bit stream. In wireless or packet networks, sometimes the transmitted frames or the packets are erased or lost. This condition is often called frame erasure in wireless networks and packet loss in packet networks. Frame erasure and packet loss may result, for example, from corruption of a frame or packet due to bit errors. For example, such bit-errors may prevent proper demodulation of the bit stream or may be detected by a forward error correction (FEC) scheme and the frame or packet discarded.

It is well known that bit errors can occur in most audio communications system. The bit errors may be random or bursty in nature. Generally speaking, random bit errors have an approximately equal probability of occurring over time, whereas bursty bit errors are more concentrated in time. As previously mentioned, bit errors may cause a packet to be discarded. In many conventional audio communications systems, packet loss concealment (PLC) logic is invoked at the decoder to try and conceal the quality-degrading effects of the lost packet, thereby avoiding substantial degradation in output audio quality. However, bit errors may also go undetected and be present in the bit stream during decoding. Some codecs are more resilient to such bit errors than others. Some codecs, such as CVSD (Continuously Variable Slope Delta Modulation), were designed with bit error resiliency in mind, while others, such as A-law or u-law pulse code modulation (PCM) are extremely sensitive to even a single bit error. Model-based codecs such as the CELP (Code Excited Linear Prediction) family of audio coders may have some very sensitive bits (e.g., gain, pitch bits) and some more resilient bits (e.g., excitation).

Today, many wireless audio communications systems and devices are being deployed that operate in accordance with Bluetooth®, an industrial specification for wireless personal area networks (PANs). Bluetooth® provides a protocol for connecting and exchanging information between devices such as mobile phones, laptops, personal computers, printers, and headsets over a secure, globally unlicensed short-range radio frequency.

The original Bluetooth® audio transport mechanism is termed the Synchronous Connection-Oriented (SCO) channel, which supplies full-duplex data with a 64 kbit/s rate in each direction. There are three codecs defined for SCO channels: A-law PCM, u-law PCM, and CVSD. CVSD is used almost exclusively due to its robustness to random bit errors. With CVSD, the audio output quality degrades gracefully as the occurrence of random bit errors increases. However, CVSD is not robust to bursty bit errors, and as a result, annoying "click-like" artifacts may become audible in the audio output when bursty bit errors occur. With other codecs such as PCM or CELP-based codecs, audible clicks may be produced by even a few random bit-errors.

In a wireless communications system such as a Bluetooth® system, bit errors may become bursty under certain interference or low signal-to-noise ratio (SNR) conditions. Low SNR conditions may occur when a transmitter and receiver are at a distance from each other. Low SNR conditions might also occur when an object (such as a body part, desk or wall) impedes the direct path between a transmitter and receiver. Because a Bluetooth® radio operates on the globally available unlicensed 2.4 GHz band, it must share the band with other consumer electronic devices that also might operate in this band including but not limited to WiFi® devices, cordless phones and microwave ovens. Interference from these devices can also cause bit errors in the Bluetooth® transmission.

Bluetooth® defines four packet types for transmitting SCO data—namely, HV1, HV2, HV3, and DV packets. HV1 packets provide ⅓ rate FEC on a data payload size of 10 bytes. HV2 packets provide ⅔ rate FEC on a data payload size of 20 bytes. HV3 packets provide no FEC on a data payload of 30 bytes. DV packets provide no FEC on a data payload of 10 bytes. There is no cyclic redundancy check (CRC) protection on the data in any of the payload types. HV1 packets, while producing better error recovery than other types, accomplish this by consuming the entire bandwidth of a Bluetooth® connection. HV3 packets supply no error detection, but consume only two of every six time slots. Thus, the remaining time slots can be used to establish other connections while maintaining a SCO connection. This is not possible when using HV1 packets for transmitting SCO data. Due to this and other concerns such as power consumption, HV3 packets are most commonly used for transmitting SCO data.

A Bluetooth® packet contains an access code, a header, and a payload. While a ⅓ FEC code and an error-checking code protect the header, low signal strength or local interference may result in a packet being received with an invalid header. In this case, certain conventional Bluetooth® receivers will discard the entire packet and employ some form of PLC to conceal the effects of the lost data. However, with HV3 packets, because only the header is protected, bit errors impacting only the user-data portion of the packet will go undetected and the corrupted data will be passed to the decoder for decoding and playback. As mentioned above, CVSD was designed to be robust to random bit errors but is not robust to bursty bit errors. As a result, annoying "click-like" artifacts may become audible in the audio output when bursty bit errors occur.

Recent versions of the Bluetooth specification (in particular, version 1.2 of the Bluetooth® Core Specification and all subsequent versions thereof) include the option for Extended SCO (eSCO) channels. In theory, eSCO channels eliminate the problem of undetected bit errors in the user-data portion of a packet by supporting the retransmission of lost packets and by providing CRC protection for the user data. However, in practice, it is not that simple. End-to-end delay is a critical component of any two-way audio communications system and this limits the number of retransmissions in eSCO channels to one or two retransmissions. Retransmissions also increase power consumption and will reduce the battery life of a Bluetooth® device. Due to this practical limit on the number of retransmissions, bit errors may still be present in the received packet. The obvious approach is to simply declare a packet loss and employ PLC. However, in most cases, there may only be a few random bit errors present in the data, in which case, better quality may be obtained by allowing the data to be decoded by the decoder as opposed to discarding the whole packet of data and concealing with PLC. As a result, the case of bit-error-induced artifacts must still be handled with eSCO channels.

The detection and concealment of clicks in audio signals is not new. However, most prior art techniques deal exclusively with detecting bit errors in memory-less codecs such as the G.711 codec, or in detecting clicks due to degradation of a storage medium. In these applications, the click is typically very short in duration and can be modeled as an impulse noise. Typical techniques used for detection include LPC inverse filtering, pitch prediction, matched filtering, median filtering, and higher order derivatives. Concealment techniques generally entail some form of sample replacement/smoothing/interpolation. However, the problem is more complex when attempting to detect clicks caused by bit errors in many audio codecs.

For example, CVSD is a memory-based audio codec that operates with a 30 sample frame size within a Bluetooth® system. As a result, the noise shape does not resemble an impulse. The noise pulse differs in at least three very important ways: (1) the noise pulse shape varies from one error frame to the next, (2) the pulse can often consume the entire length of the frame, and (3) due to the memory of CVSD, the distortion can carry into subsequent frames. These differences render the prior art techniques mostly ineffective. For example, matched filtering relies on knowledge of the noise pulse shape which in the prior art is simply an impulse. However, as described above, for CVSD the pulse shape is not known, rendering matched filtering useless. Median filtering requires a long delay and is not practical in a delay constrained two-way audio communications channel. Higher order derivatives are effective when the noise is impulsive, but are not effective when the pulse is of longer durations. LPC inverse filtering and pitch prediction are still applicable, but on their own without the other methods applied, they are not effective enough to provide reliable detection. In addition, prior art concealment techniques do not apply to this application because the distortion may be spread across several samples and potentially impact an entire frame (30 samples) or more. Thus, a more complex concealment algorithm is required.

For applications such as Bluetooth® headsets, the emphasis in design is on extremely low complexity due to the low cost and low power dissipation requirements. Therefore, what is needed is a low complexity bit error concealment algorithm that addresses the challenging requirements and constraints described above.

BRIEF SUMMARY OF THE INVENTION

A bit error concealment (BEC) system and method is described herein that detects and conceals the presence of click-like artifacts in an audio signal caused by bit errors introduced during transmission of the audio signal within an audio communications system. A particular embodiment of the present invention utilizes a low-complexity design that introduces no added delay and that is particularly well-suited for applications such as Bluetooth® wireless audio devices which have low cost and low power dissipation requirements. When implemented in a wireless audio device such as a Bluetooth® headset, an embodiment of the present invention improves the overall audio experience of a user. The invention may be implemented, for example, in mono headset devices primarily used in cell phone voice calls. Although a particular embodiment of the invention described herein is tailored for use with CVSD, it may also be used with other narrowband (8 kHz) codecs including but not limited to PCM or G.711 A-law/u-law. It may also be used in wideband applications (for example, applications in which the audio sampling rate is in the range of 16-48 kHz) utilizing codecs such as low-complexity Sub-Band Coding (SBC).

In particular, a method for performing bit error concealment in an audio receiver is described herein. In accordance with the method, a portion of an encoded bit stream is decoded to generate a decoded audio frame, wherein the decoded audio frame comprises a portion of a decoded audio signal. At least the decoded audio signal is analyzed to detect whether the decoded audio frame includes a distortion that will be audible during playback thereof, the distortion being due to bit errors in the encoded bit stream. Responsive to detecting that the decoded audio frame includes the distortion, operations are performed on the decoded audio signal to conceal the distortion.

A system is also described herein. The system includes an audio decoder, a bit error detection module and a packet loss concealment module. The audio decoder is configured to decode a portion of an encoded bit stream to generate a decoded audio frame, wherein the decoded audio frame comprises a portion of a decoded audio signal. The bit error detection module is configured to analyze at least the decoded audio signal to detect whether the decoded audio frame includes a distortion that will be audible during playback thereof, the distortion being due to bit errors in the encoded bit stream. The packet loss concealment module is configured to perform operations on the decoded audio signal to conceal the distortion responsive to detection of the distortion within the decoded audio frame.

A computer program product is also described herein. The computer program product comprises a computer-readable medium having computer program logic recorded thereon for enabling a processing unit to perform bit error concealment. The computer program logic includes first means, second means and third means. The first means are for enabling the processing unit to decode a portion of an encoded bit stream to generate a decoded audio frame, wherein the decoded audio frame comprises a portion of a decoded audio signal. The second means are for enabling the processing unit to analyze at least the decoded audio signal to detect whether the decoded audio frame includes a distortion that will be audible during playback thereof, the distortion being due to bit errors in the encoded bit stream. The third means are for enabling the processing unit to perform operations on the decoded audio signal to conceal the distortion responsive to detection of the distortion within the decoded audio frame.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
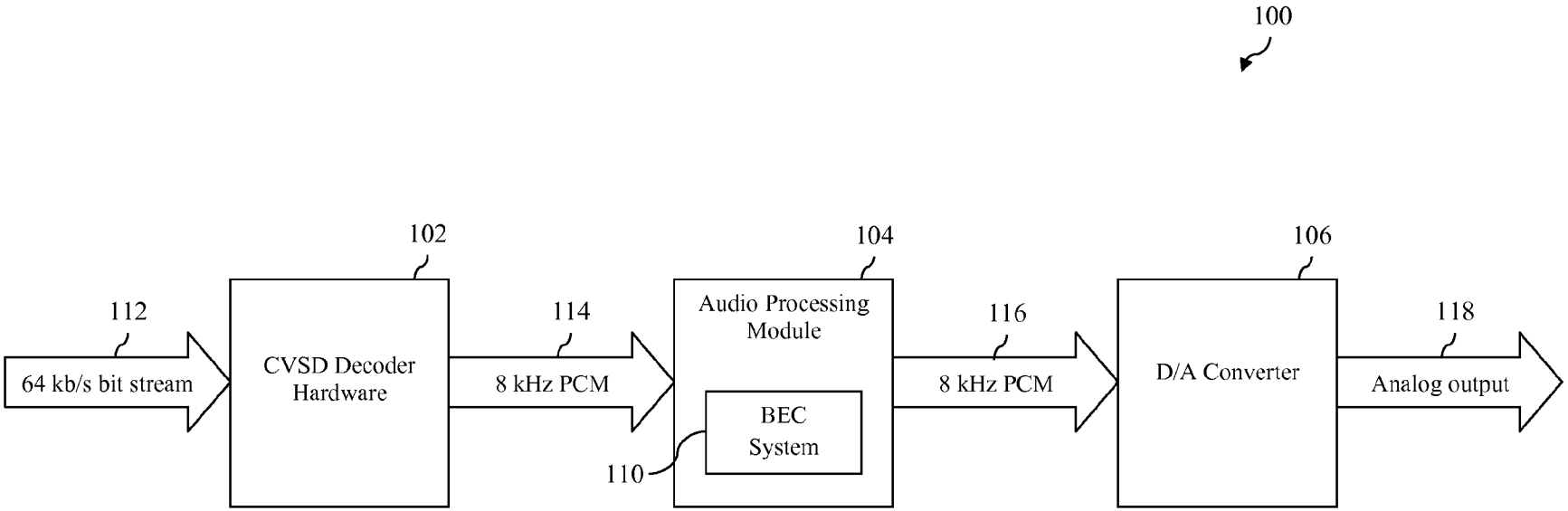
FIG. 1 is a block diagram of a receive path of an example Bluetooth® audio device in which an embodiment of the present invention may be implemented.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

I. Introduction

The following detailed description refers to the accompanying drawings that illustrate exemplary embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the art to implement such feature, structure, or characteristic in connection with other embodiments whether or not explicitly described.

An embodiment of the present invention comprises a bit error concealment (BEC) system and method that addresses the problem of undetected bit errors in an encoded audio signal received over an audio communication link, wherein the decoding of such undetected bit errors may introduce audible distortions, such as clicks, into the decoded audio signal to be played back to a user. The BEC method includes two distinct aspects: (1) detection of bit errors capable of introducing an audible artifact in an audio output signal, and (2) concealment of the artifact. A particular embodiment of the present invention will now be described in the context of a Bluetooth® audio device that uses a CVSD decoder, although the invention is not limited to such an implementation.

FIG. 1 is a block diagram of a receive path 100 of an example Bluetooth® audio device in which an embodiment of the present invention may be implemented. As shown in FIG. 1, receive path 100 includes a dedicated hardware-based CVSD decoder 102 that converts a 64 kb/s received bit stream 112 into an 8 kHz PCM signal 114. Bit stream 112 comprises a CVSD-encoded representation of an audio signal and PCM signal 114 comprises a decoded representation of the same audio signal. CVSD is a relatively simple algorithm that can be implemented very efficiently in hardware, and thus many Bluetooth® audio devices include such hardware-based CVSD decoders.

As further shown in FIG. 1, PCM signal 114 is passed from CVSD decoder 102 to audio processing module 104 for further processing. Such further processing may include, for example and without limitation, acoustic echo cancellation, noise reduction, speech intelligibility enhancement, packet loss concealment, or the like. This results in the generation of an 8 kHz processed PCM signal 116. Processed PCM signal 116 is then passed to a digital-to-analog (D/A) converter 106, which operates to convert processed PCM signal 116 from a series of digital samples into an analog form 118 suitable for playback by one or more speakers integrated with or attached to the Bluetooth® audio device.

In the example embodiment described herein, the BEC system is implemented as part of audio processing module 104. The system is shown in FIG. 1 as BEC system 110. Because audio processing module 104 does not have access to encoded 64 kb/s bit stream 112, BEC system 110 must detect bit errors and conceal artifacts resulting therefrom without knowledge of or modification to encoded bit stream 112. BEC system 110 thus only uses 8 kHz PCM signal 114 to perform the detection and concealment operations.

II. BEC System in Accordance with an Embodiment of the Present Invention

Figure 2:
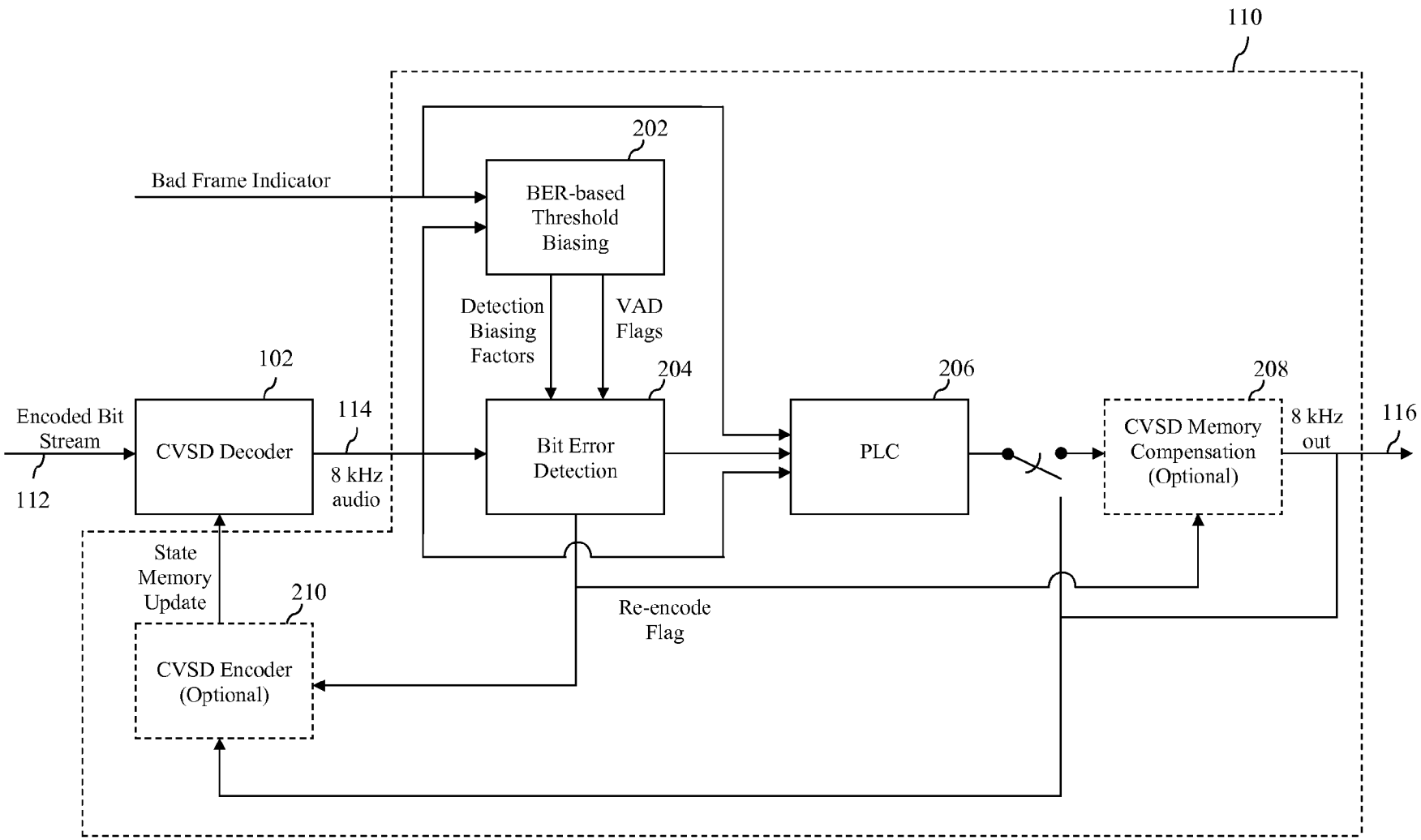
FIG. 2 is a block diagram of a bit error concealment (BEC) system in accordance with an embodiment of the present invention.

FIG. 2 is a high-level block diagram that shows one implementation of BEC system 110 of FIG. 1 in accordance with an embodiment of the present invention. As shown in FIG. 2, BEC system 110 includes a bit error rate (BER) based threshold biasing module 202, a bit error detection module 204, a packet loss concealment (PLC) module 206, an optional CVSD memory compensation module 208 and an optional CVSD encoder 210. Each element depicted in FIG. 2 will now be described.

A. CVSD Decoder 102

As previously described, CVSD decoder 102 is configured to process 64 kb/s encoded bit stream 112 to produce decoded 8 kHz 16-bit PCM audio signal 114 which is then processed by BEC system 110. Although PCM audio signal 114 is shown as being input directly to BEC system 110 in FIG. 2, it is possible that PCM audio signal may be processed by other components prior to being processed by BEC system 110. Such other components may include, for example and without limitation, an acoustic echo cancellation component, a noise reduction component, a speech intelligibility enhancement component, a packet loss concealment component.

Since the CVSD compression algorithm depends on previous samples, it is a memory-based codec and as such, both the encoder and decoder contain state memory. When packet loss or bit errors occur, the state memory of the encoder and the state memory of the decoder may become out of synchronization, thereby causing degraded performance in the decoder. As will be described herein, when this situation is detected, the CVSD decoder state may be overwritten using a state memory update to improve performance.

B. BER-Based Threshold Biasing Module 202

BER-based threshold biasing module 202 is configured to estimate a rate of audible clicks caused by bit errors and to use this information to bias certain detection thresholds. Because clicks caused by bit errors can often resemble portions of clean speech, detecting the clicks is a tradeoff between correctly identifying clicks and falsely classifying clean speech as bit-error-induced clicks. Increasing the detection rate will unavoidably increase the false detection rate as well. Therefore, there is a tradeoff between the degradation caused by missing a click and the degradation caused by false detections. Missing a click in a speech segment obviously degrades the speech because the click remains in the audio signal. A false detection degrades the speech because a perfectly fine portion of audio is replaced with a concealment waveform. The degradation caused by a false detection is generally not as great as that caused by a missed detection. This tradeoff changes with the frequency of clicks in the speech signal. To understand this, consider a signal with no bit errors. Since there are no clicks, the signal can only be degraded by false detections. In this case, the false detection rate should be as low as possible. In the other extreme, consider a signal severely degraded with several clicks per second. In this case, false detections can be tolerated in order to remove the majority of the clicks. Therefore, as the click rate increases, the optimal operating point involves more aggressive detection and consequently a higher rate of false detections.

BER-based threshold biasing module 202 uses an energy-based voice activity detection (VAD) system to estimate a click detection rate during periods of speech inactivity in PCM audio signal 114. In particular, using the VAD system, BER-based threshold biasing module 202 continuously updates an estimated click-causing bit error rate, denoted BER, during periods of speech inactivity and uses this rate to set the optimal operating point for detection. BER-based threshold biasing module holds BER constant during periods of active speech.

Generally speaking, BER-based threshold biasing module 202 detects a click only if voice activity is observed for a relatively short amount of time (e.g., a few frames). Thus a click is detected and used to update BER only when BER-based threshold biasing module 202 detects an active region of signal 114 that is quickly followed by an inactive region. If signal 114 is active for longer than a certain amount of time, a click is not detected.

In one embodiment, if BER-based threshold biasing module 202 detects a click during a period of speech inactivity, the VAD system is further monitored to make sure that the detected click does not immediately precede a prolonged active segment. This is done to avoid counting breathing or other bursty noise that often precedes somebody talking when determining BER. If it is found that the VAD system goes active for a prolonged period, any clicks that immediately preceded the active region are not counted in updating BER.

In one embodiment, if BER drops below a certain level, the remaining components in BEC system 110 are disabled. This feature is used to save battery life of the audio device. In this case, only the VAD system remains active. It is used to monitor BER. If BER later increases above an activation threshold, the full BEC system is activated to begin detection and removal of click artifacts.

It is assumed that as BER increases, the packet loss rate will also increase. This is understandable since it would be expected that as the frequency of click-causing bit errors that hit only the user-data portion of the packet increases, the frequency of bit errors that also hit the header and thus get detected by CRC will also increase. In order to avoid a scenario where a clean input signal tricks BER to falsely increase, a packet loss rate, denoted PLR, is monitored and BER is limited to be a function of PLR. For example, if no packets have been lost in the recent past, PLR would be close to zero (or equal to zero). This information is used to establish a cap on the estimated click-causing bit error rate. In this case, it would be expected that BER should also be close to zero. If it is not, it is limited to such. Hence, $$BER=\min(BER,f(PLR)) \quad (1)$$

BER-based threshold biasing module 202 may determine PLR by tracking a bad frame indicator (BFI) that is associated with each frame and that is received from another component within the audio terminal, such as a channel decoder/demodulator, that performs error checking on the header of each received Bluetooth® packet.

BER-based threshold biasing module 202 uses BER to determine certain detection biasing factors that are used by bit error detection module 204 in detecting clicks in PCM audio signal 204. These detection biasing factors are used to control the sensitivity level of bit error detection module 204. Generally speaking, as BER increases, the detection biasing factors are adapted so that the sensitivity level of bit error detection module 204 will increase (i.e., bit error detection module 204 will be more likely to detect bit-error-induced clicks) while as BER decreases, the detection biasing factors are adapted so that the sensitivity level of bit error detection module 204 will decrease (i.e., bit error detection module 204 will be less likely to detect bit-error-induced clicks).

In one embodiment, BER-based threshold biasing module 202 uses BER to determine two detection biasing factors, denoted kbfe0 and kbfe12, that are used by bit error detection module 204 in detecting clicks in PCM audio signal 204. As will be described in more detail herein, the detection biasing factor kbfe0 is used when a pitch tracking classification currently assigned to decoded audio signal 114 is random, whereas the detection biasing factor kbfe12 is used when a pitch tracking classification currently assigned to decoded audio signal 114 is tracking or transitional. In one embodiment, the values of the two detection biasing factors are stored in look-up tables that are referenced based on the current value of BER.

C. Bit Error Detection Module 204

Figure 3:
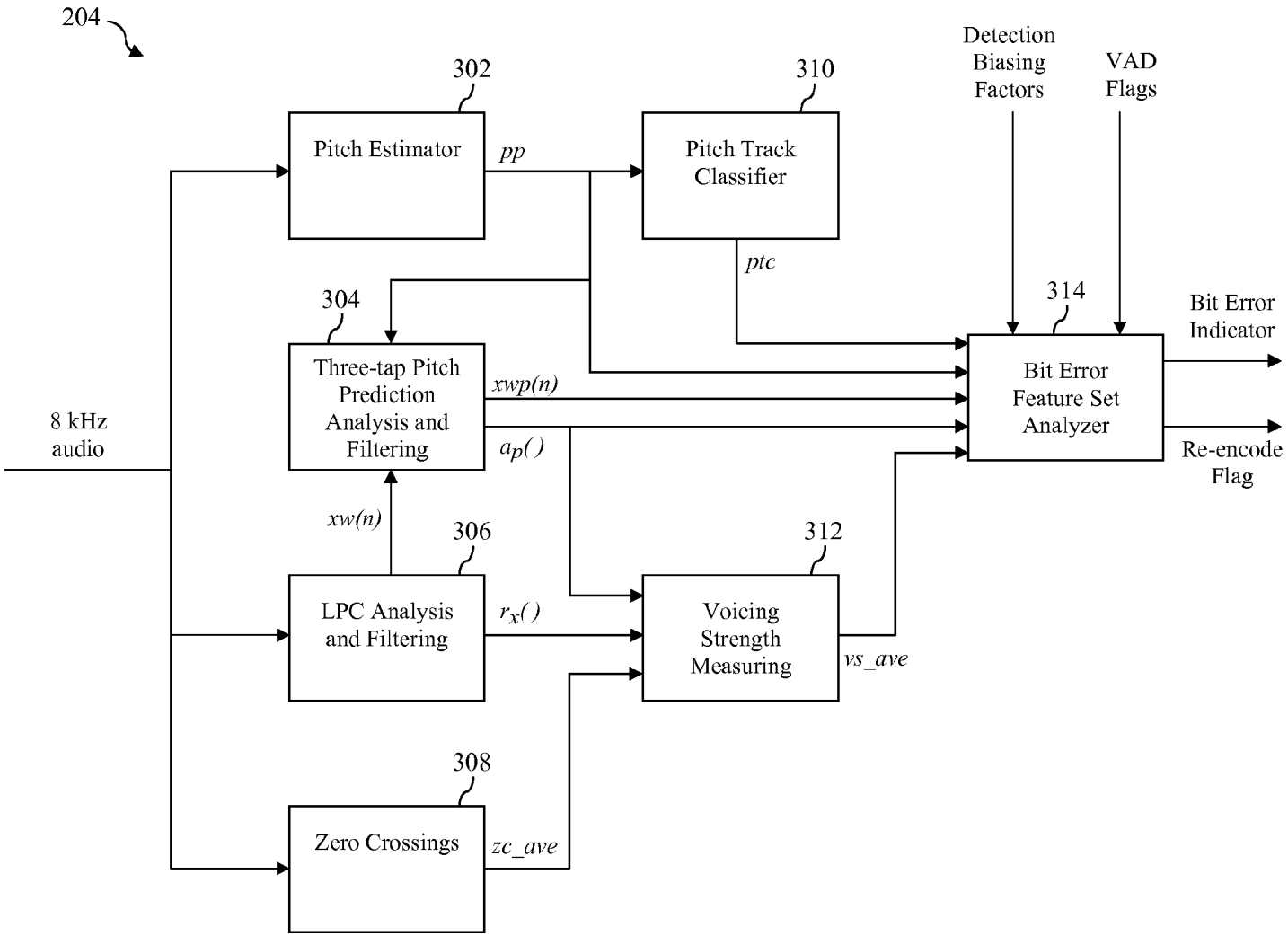
FIG. 3 is a block diagram of one implementation of a bit error detection module that is included within a BEC system in accordance with an embodiment of the present invention.

Bit error detection module 204 attempts to detect clicks in the 8 kHz audio signal 114 caused by bit-errors while at the same time minimizing false detections caused by segments of speech that are mistaken for clicks. A detailed block diagram of one implementation of bit error detection module 204 is shown in FIG. 3. As shown in FIG. 3, bit error detection module 204 includes a pitch estimator 302, a three-tap pitch prediction analysis and filtering module 304, an LPC analysis and filtering module 306, a zero crossings tracker 308, a pitch track classifier 310, a voicing strength measuring module 312 and a bit error feature set analyzer 314. Each of these elements will now be described.

1. Pitch Estimator 302

Pitch estimator 302 is configured to receive decoded 8 kHz audio signal 114 and to analyze that signal to estimate a pitch period associated therewith. Pitch estimation is well-known in the art and any number of conventional pitch estimators may be used to perform this function. In one embodiment, pitch estimator 302 comprises a simple, low-complexity pitch estimator based on an average mean difference function (AMDF). As shown in FIG. 3, pitch estimator 302 provides the estimated pitch period, denoted pp, to 3-tap pitch prediction analysis and filtering module 304, pitch track classifier 310, and bit error feature set analysis module 314.

2. Pitch Track Classifier 310

Pitch track classifier 310 is configured to analyze the pitch history (based on the pitch period, pp) and to classify it into one of three pitch track classifications: tracking, transitional, or random. This pitch track classification, denoted ptc, is then passed to bit error feature set analyzer 314 where it is used in determining if a click is present. It has been observed that the pitch track correlates well with the predictability of a current speech signal based on past information. If the pitch track classification is "tracking," then it is more likely that if a segment of speech from the current frame does not match well with the past, it is a click. On the other hand, if the pitch track classification is "random," the speech signal has low predictability and more care must be taken in declaring a click.

3. LPC Analysis and Filtering Module 306

LPC analysis and filtering module 306 is configured to perform a so-called "LPC analysis" on 8 kHz audio signal 114 to update coefficients of a short-term predictor, denoted $a_i$. Let M be the filter order of the short-term predictor, then the short-term predictor can be represented by the transfer function $$P(z) = \sum_{i=1}^{M} a_i z^{-i}, \tag{2}$$

where $a_i$, i=1, 2, . . . , M are the short-term predictor coefficients. LPC analysis and filtering module 306 analyzes 8 kHz audio signal 114 to calculate the short-term predictor coefficients $a_i$, i=1, 2, . . . , M. Any reasonable analysis window size, window shape and LPC analysis method can be used. In one embodiment, the short-term predictor order M is 8.

Once the short-term predictor coefficients are computed, LPC analysis and filtering module 306 obtains a short-term residual signal by inverse short-term filtering the current frame of 8 kHz audio signal 114 by using a filter with a transfer function $$A(z)=1-P(z). \tag{3}$$

A vector xw(n) is used to hold the short-term residual computed for the current frame as well as to buffer samples computed for previously-processed frames. In particular, the short-term residual for the current frame is held in xw(XWOFF:XWOFF+FRSZ−1), wherein XWOFF denotes an offset into vector xw(n) and FRSZ denotes the frame size in samples. For ease of description, a standard Matlab® vector index notation has been used herein to describe vectors, where x(j:k) means a vector containing the j-th element through the k-th element of the x array. Specifically, x(j:k)= [x(j), x(j+1), x(j+2), . . . , x(k−1), x(k)].

As shown in FIG. 3, LPC analysis and filtering module 306 also provides autocorrelation coefficients $r_x(0)$ and $r_x(1)$ used in performing the LPC analysis to voicing strength measuring module 312.

4. Three-Tap Pitch Prediction Analysis and Filtering Module 304

Three-tap pitch prediction analysis and filtering module 304 is configured to compute three-tap pitch predictor coefficients, denoted $a_p(\,)$, based on the short-term residual signal xw(n) received from LPC analysis and filtering module 306 and on the pitch period, pp, received from pitch estimator 302. Both the covariance and the autocorrelation methods can be used to find the coefficients. Using the autocorrelation approach for a three-tap pitch predictor leads to the following system of equations:

$$\begin{bmatrix} r_{xw}(0) & r_{xw}(1) & r_{xw}(2) \\ r_{xw}(1) & r_{xw}(0) & r_{xw}(1) \\ r_{xw}(2) & r_{xw}(1) & r_{xw}(0) \end{bmatrix} \begin{bmatrix} a_p(-1) \\ a_p(0) \\ a_p(1) \end{bmatrix} = \begin{bmatrix} r_{xw}(pp-1) \\ r_{xw}(pp) \\ r_{xw}(pp+1) \end{bmatrix} \tag{4}$$

where $$r_{xw}(m) = \sum_{n=n_0}^{n=n_0+N-m-1} xw(n)\cdot xw(n+m) \tag{5}$$

$$m = 0 \ldots 2,$$

$$r_{xw}(pp+i) = \sum_{n=n_0}^{n=n_0+N-1} xw(n)\cdot xw(n-pp-i) \tag{6}$$

$$i = -1, 0, 1,$$

$$n_0 = XWOFF + FRSZ - LTWSZ \tag{7}$$

and $$N = LTWSZ = \min(pp, 80). \tag{8}$$

In the foregoing system of equations, XWOFF is the offset into vector xw(n) at which the short-term residual for the current frame begins, FRSZ is the number of samples in a frame, and LTWSZ is the number of samples in a long-term window used for computing the three-tap pitch predictor coefficients.

After the three-tap pitch predictor coefficients $a_p(\,)$ have been computed, three-tap pitch prediction analysis and filtering module 304 then computes a long-term prediction residual, denoted xwp(n), according to:

$$xwp(n+XWPOFF) = xw(n+XWOFF) - \sum_{m=-1}^{m=1} a_p(m)\cdot xw(n+XWOFF-pp-m) \tag{9}$$

$$\text{for } n = 0 \ldots FRSZ-1$$

The vector xwp(n) is used to hold the long-term prediction residual computed for the current frame as well as to buffer samples computed for previously-processed frames. In particular, the long-term prediction residual for the current frame is held in xwp(XWPOFF:XWPOFF+FRSZ−1), wherein XWPOFF denotes an offset into vector xwp(n) and FRSZ denotes the frame size in samples.

It is noted that although this embodiment of BEC system 110 utilizes a three-tap pitch predictor, any number of taps may be used.

5. Zero Crossings Tracker 308

Zero crossings tracker 308 is configured to compute a number of times that 8 kHz audio signal 114 crosses zero (i.e., transitions from a positive sample value to a negative sample value or vice versa) during the current frame, denoted zc. Zero crossings tracker 308 is further configured to calculate a running average for the current frame, denoted zc_ave(k), in accordance with:

$$zc_ave(k)=(1-\beta_{zc})\cdot zc+\beta_{zc}\cdot zc_ave(k-1) \tag{10}$$

where k is a value of a frame counter corresponding to the current frame, zc_ave(k−1) is the running average for the preceding frame, and $\beta_{zc}$ is a forgetting factor. In one implementation, $\beta_{zc}$ is set to 0.7. Zero crossing tracker 308 outputs the running average for each frame to voicing strength measuring module 312.

6. Voicing Strength Measuring Module 312

Voicing strength measuring module 312 is configured to compute a voicing strength for the current frame, denoted vs, which is essentially a measure of the degree to which the current frame is periodic and predictable. The voicing strength vs may be computed in accordance with:

$$vs = \min\left(\max\left(\frac{\left(\min\left(\max\left(\frac{15 - zc_ave}{10}, 0\right), 1\right) + \frac{r_x(1)}{r_x(0)} + \sum_{m=-1}^{m=1} a_p(m)\right)}{3}, 0\right), 1\right) \quad (11)$$

wherein zc_ave is the average zero crossings for the current frame obtained from zero crossings tracker 308, $r_x(0)$ and $r_x(1)$ are autocorrelation coefficients received from LPC analysis and filtering module 306, and $a_p(-1)$, $a_p(0)$ and $a_p(1)$ are the three-tap pitch prediction coefficients received from three-tap pitch prediction analysis and filtering module 304.

Voicing strength measuring module 312 is further configured to calculate an average voicing strength for the current frame, denoted vs_ave(k), in accordance with $$vs_ave(k)=(1-\beta_{vs})\cdot vs+\beta_{vs}\cdot vs_ave(k-1) \quad (12)$$

where k is a value of a frame counter that for the current frame, vs_ave(k−1) is the average voicing strength for the preceding frame, and $\beta_{vs}$ is a forgetting factor. In one implementation, $\beta_{vs}$ is set to 0.6. Voicing strength measuring module 312 outputs the average voicing strength for each frame to bit error feature set analyzer 314.

7. Bit Error Feature Set Analyzer 314

Figure 4:
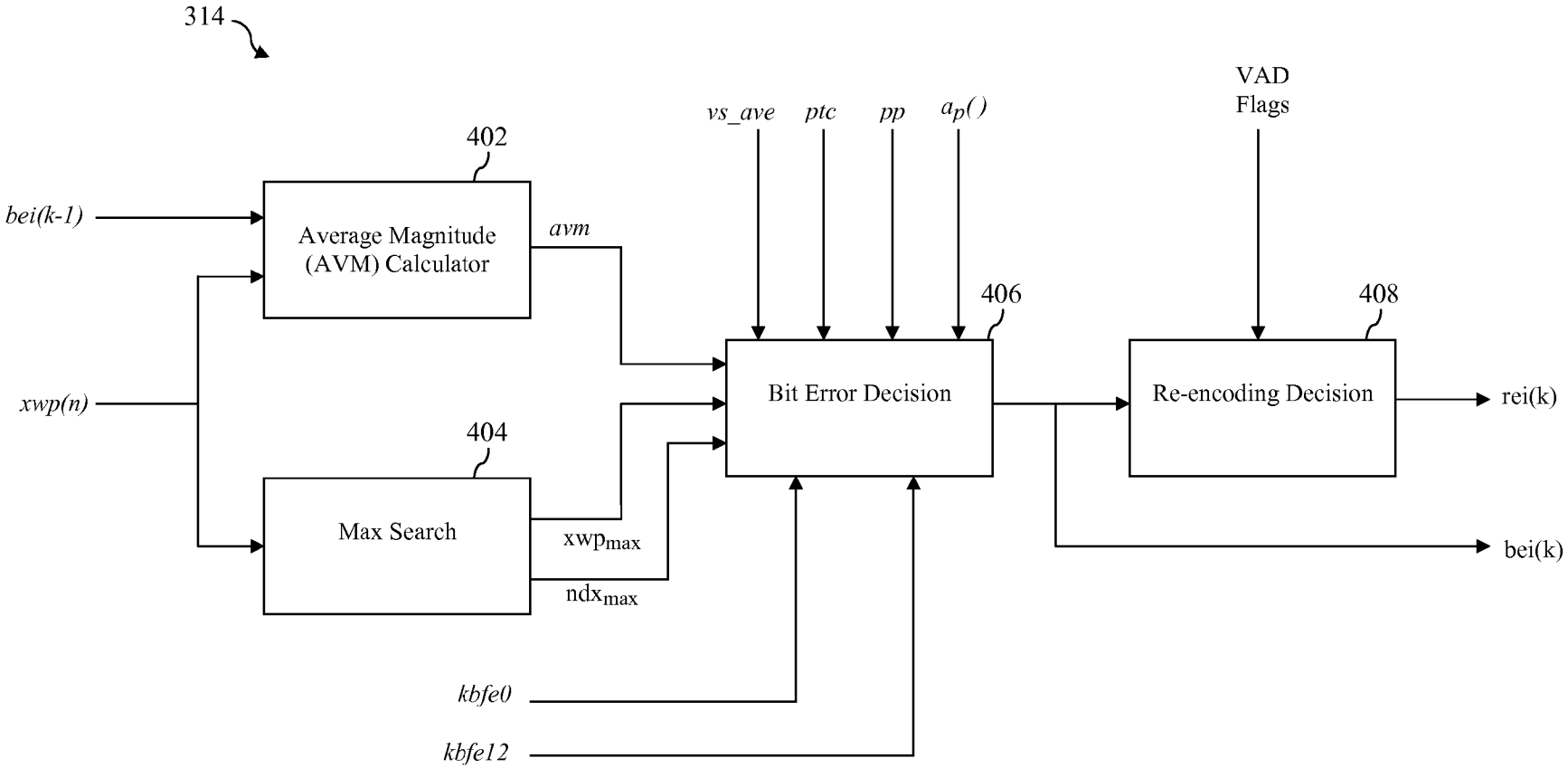
FIG. 4 is a block diagram of a bit error feature set analyzer that is included within a bit error detection module in accordance with an embodiment of the present invention.

Bit error feature set analyzer 314 is configured to use several features and signals to determine if a click is present in the current frame of 8 kHz audio signal 114. FIG. 4 is a block diagram that depicts functional elements of bit error feature set analyzer 314 in accordance with one implementation of the present invention. As shown in FIG. 4, these elements include an average magnitude (AVM) calculator 402, a maximum search module 404, a bit error decision module 406 and a re-encoding decision module 408. These elements will be described below.

The outputs of bit error feature set analyzer 314 include a bit error indicator, denoted bei, and a re-encoding flag, denoted rei. The bit error indicator indicates whether a click is present in the current frame. In one embodiment, if bei=1 then it has been determined that a click is present in the current frame and if bei=0 then it has been determined that a click is not present in the current frame. The re-encoding flag is used to enable or disable re-encoding for the current frame. As will be discussed in more detail below, re-encoding involves encoding a concealment waveform used to replace a frame of the decoded audio signal so as to synchronize the state memory of CVSD decoder 102. In one embodiment, if rei=1, then re-encoding has been enabled for the current frame and if rei=0 then re-encoding has been disabled for the current frame.

a. AVM Calculator 402

AVM calculator 402 computes an average magnitude, denoted avm, of a segment within the long-term prediction residual, xwp(n), which is calculated by three-tap prediction analysis and filtering module 304 in a manner previously described. If the frame preceding the current frame did not contain a bit-error (in other words, if bei(k−1)=0), then AVM calculator 402 calculates avm in accordance with:

$$avm = \sum_{n=n_{avm}}^{n=n_{avm}+AVMWL-1} |xwp(n)|, \quad (13)$$

where $$n_{avm} = XWPOFF - AVMWL \quad (14)$$

In the foregoing, A VMWL is the window length. In one embodiment, A VMWL is set to 40.

Note that the above algorithm uses the samples in xwp(n) from the frame preceding the current frame. This is to avoid including samples that may be corrupted by bit errors in the current frame. However, if the preceding frame contained bit errors (in other words, if bei(k−1)=1), then the preceding frame will have been replaced by some concealment algorithm and thus the samples in xwp(n) associated with the preceding frame will not be useful in detecting bit errors. In this case, AVM calculator 402 will use an alternative algorithm to calculate avm that only uses samples in xwp(n) that correspond to the current frame. However, to avoid using samples that may be corrupted by any potential bit errors in the current frame, AVM calculator 402 throws the peak value(s) out of the calculation.

b. Maximum Search Module 404

Maximum search module 404 is configured to search the long-term prediction residual for the current frame in xwp(n), which is calculated by three-tap pitch prediction analysis and filtering module 304 in a manner previously described, to identify the maximum absolute value $xwp_{max}(k)$ and the index, $ndx_{max}(k)$, of its location. The value of $xwp_{max}(k)$ is determined in accordance with $$xwp_{max}(k)=\max(|xwp(n)|)n=XWPOFF \ldots XWPOFF+FRSZ-1 \quad (15)$$

wherein XWPOFF denotes the offset into vector xwp(n) at which the long-term prediction residual for the current frame begins.

c. Bit Error Decision Module 406

Bit error decision module 406 is configured to determine whether or not an audible click exists within the current frame of 8 kHz audio signal 114 and to output a bit error indicator, be, based on the determination. In the implementation described herein, bit error decision module uses different thresholds for making the decision depending upon the pitch track classification, ptc, for the current frame. As noted above, the pitch track classification for the current frame is provided by pitch track classifier 310.

i. Threshold when Pitch Tracking Classification is Random

If the pitch track classification, ptc, indicates that the pitch history is random, then the speech signal is not strongly periodic at the pitch period. In this case, bit error decision module 406 determines the threshold for decision, K1, as a function of the average voicing strength for the current frame, vs_ave:

$$K1=f(vs_ave). \quad (16)$$

One manner of implementing function $f$(vs_ave) in Equation 16 is specified by

IF vs_ave<0.7

K1=11.5

ELSE $$K1=23.333-18.333\cdot vs_ave \quad (17)$$

Bit error decision module 406 then scales the threshold K1 by the biasing factor kbfe0, which is provided by BER-based threshold biasing module 202:

$$K1=K1\cdot kbfe0 \tag{18}$$

Finally, bit error decision module 406 incorporates a factor $k_{pp}$ that reduces the chance of false detections:

$$\begin{aligned}&\text{IF } |ndx_{max}(k-1)+ndx_{max}(k)-pp|\le 3\\&k_{pp}=\min\left(\max\left(\frac{xwp_{max}(k-1)}{avm(k-1)}\cdot\frac{avm(k)}{xwp_{max}(k)},1\right),3\right).\\&K1=K1\cdot k_{pp}\\&\text{END}\end{aligned} \tag{19}$$

ii. Threshold when Pitch Tracking Classification is Tracking or Transitional

If the pitch track classification, ptc, indicates that the pitch history is tracking, bit error decision module 406 calculates the threshold for decision, K1, as a function of the 3-tap pitch prediction. Let the sum of the 3-tap coefficients in the current, or kth, frame be defined as:

$$apsum(k)=\sum_{m=-1}^{m=1}a_p(m). \tag{20}$$

Then the difference between the sums associated with subsequent frames can be computed as:

$$apdiff=apsum(k)-apsum(k-1). \tag{21}$$

The threshold for decision, K1, is made a function of apdiff:

$$K1=f(apdiff). \tag{22}$$

This function may be trained over a large dataset. In one embodiment, a lookup table is used to obtain K1.

If the pitch tracking classification, ptc, indicates that the pitch track is transitional (i.e., it is generally smooth but exhibits some transitional character), then bit error decision module 406 calculates the threshold for decision, K1, as a function of the average voicing strength for the current frame, vs_ave:

$$K1=f(vs_ave). \tag{23}$$

One manner of implementing function $f$(vs_ave) in Equation 23 is specified by:

$$\begin{aligned}&\text{IF}(vs_ave\le 0.5)\\&K1=10.0\\&\text{ELSEIF}(vs_ave\le 0.9)\\&K1=6.0\\&\text{ELSE}\\&K1=4.0\\&\text{END}\end{aligned} \tag{24}$$

In the case where the pitch tracking classification is either tracking or transitional, bit error decision module 406 then scales the threshold K1 by the biasing factor kbfe12, which is provided by BER-based threshold biasing module 202:

$$K1=K1\cdot kbfe12 \tag{25}$$

When the pitch tracking classification is either tracking or transitional, bit error decision module 406 scales the threshold K1 to minimize false detections in accordance with:

$$\begin{aligned}&\text{IF } |ndx_{max}(k-1)+ndx_{max}(k)-pp|\le 3\\&k_{pp}=\min\left(\max\left(\frac{xwp_{max}(k-1)}{avm(k-1)}\cdot\frac{avm(k)}{xwp_{max}(k)},1\right),3\right)\\&K1=K1\cdot k_{pp}\\&\text{END}\end{aligned} \tag{26}$$

iii. Final Decision

After bit error decision module 406 has determined the threshold for decision, K1, it makes the final decision as to whether an audible click exists within the current frame. In one embodiment, bit error decision module 406 makes the final decision by comparing the maximum absolute value $xwp_{max}(k)$ of the long-term prediction residual for the current frame to the average magnitude avm of a segment within the long-term prediction residual multiplied by the threshold K1:

$$\begin{aligned}&\text{IF}(xwp_{max}(k)>K1\cdot avm)\\&bei=1\\&\text{ELSE}\\&bei=0\\&\text{END}\end{aligned} \tag{27}$$

Here bei is set to 1 if a click is present and bei is set to 0 if a click is not present. If the maximum value of the long-term prediction residual is much greater than the average magnitude, then this tends to indicate that a bursty bit error sufficient to create an audible click is present in the frame. However, as the threshold for decision K1 increases, the more difficult it will be to detect such a bursty bit error. Thus, the threshold K1 advantageously allows other factors to be considered in detecting clicks, such as the bit error frequency rate determined by BER-based threshold biasing module 202, the pitch track classification, and the various other factors used to determine K1 as set forth above. This allows the sensitivity for detecting clicks to be adjusted in accordance with the changing character of the input audio signal.

d. Re-Encoding Decision Module 408

Re-encoding decision module 408 is configured to set a re-encoding flag, denoted rei, that is used to enable or disable re-encoding for the current frame. In one embodiment, re-encoding decision module 408 sets the re-encoding indicator in accordance with:

$$\begin{aligned}&\text{IF}(bei=1)\text{AND}(ptc=1,2)\\&rei=1\\&\text{ELSEIF}(bei=1)\text{AND}(vad=0)\text{AND}(evad=0)\\&rei=1\\&\text{ELSE}\\&rei=0\\&\text{END}\end{aligned} \tag{28}$$

Here rei is set to 1 if re-encoding is enabled for the current frame and rei is set to 0 if re-encoding is disable for the current frame.

The first "IF" statement above ensures that if there is a bit-error-induced click and the pitch track is tracking or slightly transitional, then re-encoding is performed. In general, re-encoding performs well in highly predictable regions where the concealment signal closely resembles the original signal. In this case, re-encoding benefits the overall quality. However, unvoiced regions are not very predictable, and the concealment waveform may not closely match the original speech. As a result, re-encoding provides little or no benefit.

The "ELSEIF" condition is used to declare re-encoding during background noise. Re-encoding is extremely important in background noise. Any lingering distortion due to decoder memory effects is especially audible in low level background noise conditions. For example, the bit-errors may cause a significant increase in the step-size of the CVSD decoder. This erroneously large step-size can cause a large energy increase in background noise well after the occurrence of the bit-errors. It may take 20-40 ms before the step-size error has decayed to an inaudible level.

The vad signal is used to indicate the existence (vad=1) or absence (vad=0) of active speech. The vad signal is generated by BER-based threshold biasing module 202. In an embodiment, the vad signal is delayed by one frame in order to avoid the case where vad=1 is triggered due to the energy increase of a bit-error-induced click itself.

The evad signal is a more sensitive signal that is used to detect small increases in energy above a background noise floor and aids in avoiding re-encoding during a false detection of a speech onset. The evad signal is also generated by BER-based threshold biasing module 202. It is very difficult to differentiate between a speech onset and a bit-error-induced click. One important difference that evad attempts to exploit is the fact that bit-errors are frame aligned in Bluetooth®. The errors may begin anywhere within a frame, but due to the Automatic Frequency Hopping (AFH) feature in Bluetooth™, the bit-errors generally do not cross frame boundaries. As a result, it is expected that the frame preceding the bit error will not have any increase in energy beyond what is expected from the background noise. However, speech onsets are not frame aligned. Thus the first partial frame of a speech onset may have vad=0 because the activity threshold is not met. However, this small increase in energy is detected by evad. Hence, to increase the probability that re-encoding is not triggered for speech onsets, both vad and evad must be equal to 0 for the re-encoding flag to be triggered.

e. Memory Update Module

In an embodiment, bit error feature set analyzer 314 also includes a memory update module (not shown in FIG. 4) that updates the index at which the maximum absolute value $xwp_{max}(k)$ of the long-term prediction residual is located, $ndx_{max}(k)$, based on whether a bit-error-induced click has been detected or not. The update may be performed in accordance with:

$$\begin{aligned} &\text{IF}(bei=1) \\ &ndx_{max}(k)=FRSZ-ndx_{max}(k) \\ &\text{ELSE} \\ &ndx_{max}(k)=ndx_{max}(k)+FRSZ \\ &\text{END} \end{aligned} \tag{29}$$

D. PLC Module 206

PLC module 206 is configured to determine if the current frame has been lost based on the state of a bad frame indicator (BFI) received from another component within the audio terminal (such as for example, a channel decoder/demodulator that performs error checking on the headers of received packets). Responsive to determining that the frame has been lost, PLC module 206 will operate to conceal the lost waveform. In addition, if the BFI indicates the current frame is not lost, but bit error detection module 204 declares the frame to contain a bit-error induced click (bei=1), then PLC module 206 is also invoked to conceal the corrupted waveform.

The PLC technique used by PLC module 206 may be one described in commonly-owned co-pending U.S. patent application Ser. No. 12/147,781 to Chen, entitled "Low-Complexity Frame Erasure Concealment," the entirety of which is incorporated by reference herein. Bit error detection module 204 may be designed to share components with PLC module 206 so implemented in order to minimize computational complexity. However, bit error detection module 204 may be used in conjunction with any state-of-the-art PLC algorithm.

BER-based threshold biasing module 202, bit error detection 204 and PLC module 206 operate together to implement a bit error concealment (BEC) algorithm that is capable of detecting and concealing clicks and other artifacts due to bit errors in the encoded bit stream or from other sources.

It is noted that the re-encoding indicator (rei) is set to 1 for all lost (BFI=1) frames.

E. CVSD Memory Compensation Module 208

BEC system 110 may optionally include CVSD memory compensation module 208. In an implementation in which a CVSD encoder block is not available for re-encoding of the PLC output and subsequent state memory update of CVSD decoder 102, this module may be used. CVSD memory compensation module 208 attempts to compensate for a mismatch in encoder and decoder state memory after a frame has been corrupted by bit errors.

F. CVSD Encoder 210

CVSD encoder 210 may optionally be used to re-encode the output of PLC module 206 to obtain an estimate of the state memory at the CVSD encoder. This estimate may then be used to update the state memory at CVSD decoder 102 to keep the encoder and decoder state memories synchronized as much as possible.

III. BEC Method in Accordance with an Embodiment of the Present Invention

Figure 5:
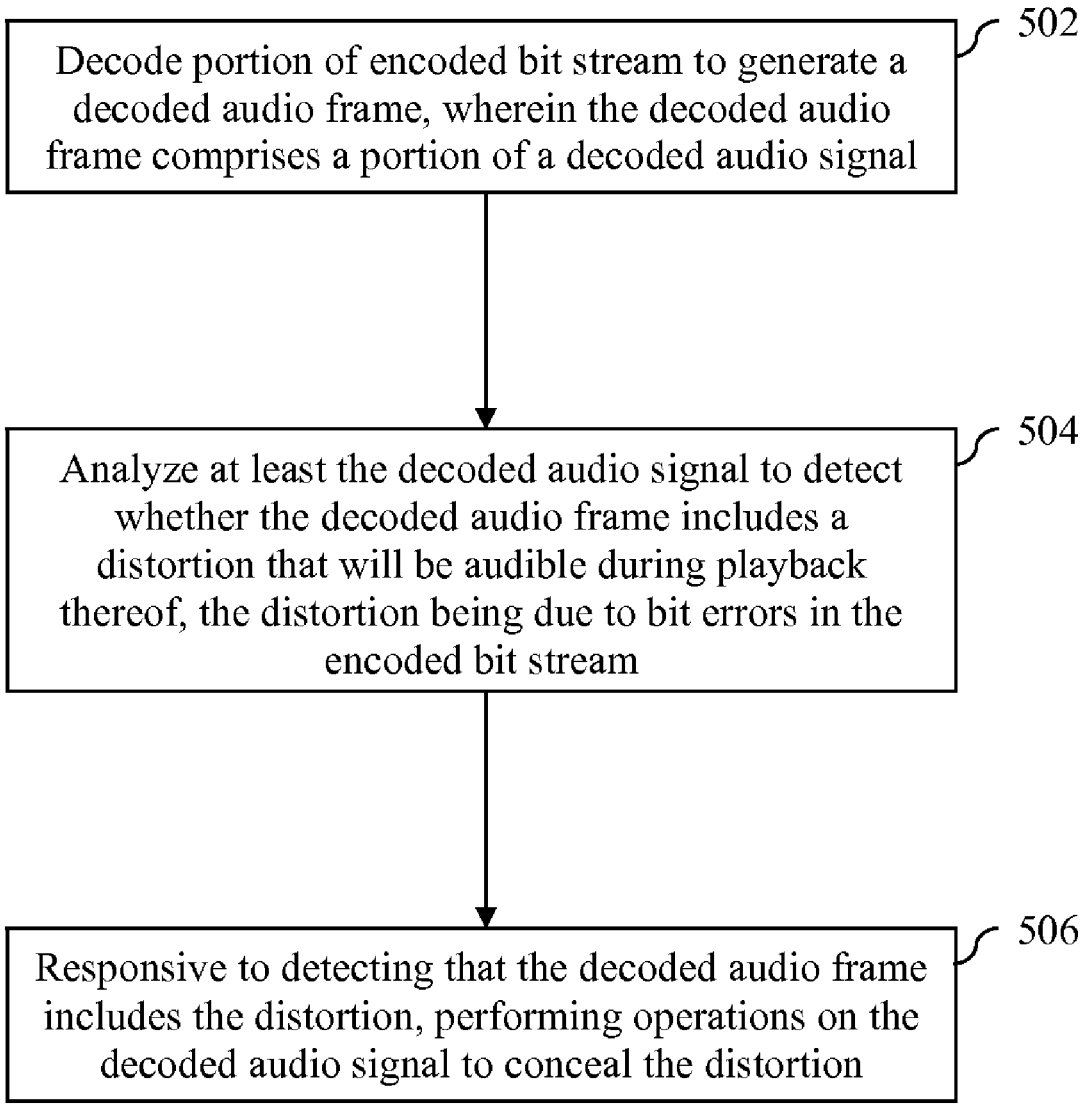
FIG. 5 depicts a flowchart of a method for performing bit error concealment in an audio receiver in accordance with an embodiment of the present invention.

FIG. 5 depicts a flowchart 500 of a general method for performing bit error concealment in an audio receiver in accordance with an embodiment of the present invention. The method of flowchart 500 may be performed, for example, by the elements of exemplary audio device 100, including BEC system 110, as described above. However, the method is not limited to that implementation.

As shown in FIG. 5, the method of flowchart 500 begins at step 502 in which a portion of an encoded bit stream is decoded to generate a decoded audio frame, wherein the decoded audio frame comprises a portion of a decoded audio signal. In the implementation described above in reference to exemplary audio device 100, this step is performed by CVSD decoder 102. However, depending upon the implementation, this step may be performed by any of a variety of decoder types including, but not limited to, a pulse code modulation (PCM) decoder, a G.711 decoder, or a low-complexity sub-band codec (SBC) decoder.

At step 504, at least the decoded audio signal is analyzed to detect whether the decoded audio frame includes a distortion that will be audible during playback thereof, the distortion being due to bit errors in the encoded bit stream.

In one embodiment, step 504 includes determining if a maximum absolute sample value in a segment of a prediction residual that is associated with the decoded audio frame exceeds an average signal level of the prediction residual for the decoded audio frame multiplied by an adaptive threshold. For example, in BEC system 110 described above, bit error decision module 406 within bit error feature set analyzer 314 (which is a component of bit error detection module 204) performs this step by determining if the maximum absolute sample value in a segment of a long-term prediction residual that is associated with the decoded audio frame ($xwp_{max}(k)$) exceeds an average magnitude of the long-term prediction residual for the decoded audio frame (avm) multiplied by an adaptive threshold (K1). It is noted that instead of calculating an average magnitude, an embodiment of the present invention may alternatively determine the average signal level of the prediction residual for the decoded audio frame by computing an energy level of the prediction residual for the decoded audio frame.

Depending upon the implementation, step 504 may include analyzing a pitch history of the decoded audio signal, assigning the pitch history to one of a plurality of pitch track categories based on the analysis and modifying a sensitivity level for detecting whether the decoded audio frame includes the distortion based on the pitch track category assigned to the pitch history. In BEC system 110 described above, pitch track classifier 310 within bit error detection module 204 performs the steps of analyzing the pitch history of the decoded audio signal and assigning the pitch history to one of a plurality of pitch track categories (random, tracking or transitional) based on the analysis. Bit error decision module 406 within bit error feature set analyzer 314 modifies the sensitivity level for detecting whether the decoded audio frame includes the distortion based on the pitch track category assigned to the pitch history, by taking the assigned pitch track category into account when calculating the threshold for detection K1.

Step 504 may also include computing a plurality of pitch predictor taps associated with the decoded audio frame and modifying a sensitivity level for detecting whether the decoded audio frame includes the distortion based on a difference between a sum of the plurality of pitch predictor taps associated with the decoded audio frame and a sum of a plurality of pitch predictor taps associated with a previously-decoded audio frame. In BEC system 110 described above, three-tap pitch prediction analysis and filtering module 304 within bit error detection module 204 performs the step of computing the plurality of pitch predictor taps associated with the decoded audio frame. Bit error decision module 406 within bit error feature set analyzer 314 performs the step of modifying the sensitivity level for detecting whether the decoded audio frame includes the distortion based on the difference between the sum of the plurality of pitch predictor taps associated with the decoded audio frame and the sum of the plurality of pitch predictor taps associated with the previously-decoded audio frame by calculating the threshold for detection K1 as a function of apdiff when the pitch track classification is tracking.

Step 504 may additionally include calculating a voicing strength measure associated with the decoded audio frame and modifying a sensitivity level for detecting whether the decoded audio frame includes the distortion based on the voicing strength measure. In BEC system 110 described above, voicing strength measuring module 312 within bit error detection module 204 performs the step of calculating the voicing strength measure associated with the decoded audio frame. Bit error decision module 406 within bit error feature set analyzer 314 performs the step of modifying the sensitivity level for detecting whether the decoded audio frame includes the distortion based on the voicing strength measure by calculating the threshold for detection K1 as a function of vs_ave when the pitch track classification is random or transitional.

At step 506, responsive to detecting that the decoded audio frame includes the distortion, operations are performed on the decoded audio signal to conceal the distortion. In BEC system 110 described above, PLC module 206 performs this step by replacing the decoded audio frame with a synthesized audio frame generated in accordance with a packet loss concealment algorithm.

The foregoing method of flowchart 500 may further include the step of performing a state memory update of the audio decoder based on re-encoding of the synthesized audio frame produced by PLC module 206 responsive to at least detecting that the decoded audio frame includes the distortion. In BEC system 110, this step is performed by optional CVSD encoder 210 responsive to the setting of the re-encoding indicator (rei) to 1 by re-encoding decision module 408. As described above, the re-encoding decision may be based both on the detection of the distortion in the decoded audio frame (as signified by the setting of bei=1) as well as by the determination that the decoded audio signal represents background noise (when vad=0 and evad=0).

The foregoing method of flowchart 500 may also include analyzing non-speech segments of the decoded audio signal to estimate a rate at which audible distortions are detected and adapting at least one biasing factor based on the estimated rate, wherein the at least one biasing factor is used to determine a sensitivity level for detecting whether the decoded audio frame includes the distortion. In BEC system 110, this step is performed by BER-based threshold biasing module 202, which determines the estimated rate at which audible distortions are detected, BER, and then adapts the biasing factors kbfe0 and kbfe12 based on the value of BER. These factors are then used by bit error decision module to determine the threshold for decision K1. As discussed above in reference to BER-based threshold biasing module 202, estimating the rate at which audible distortions are detected may include limiting the estimated rate to a function of a received packet loss rate. As further discussed above in reference to BER-based threshold biasing module 202, if the estimated rate is determined to be below a predefined threshold, module 202 may disable at least bit error detection module 204 to conserve power.

Figure 6:
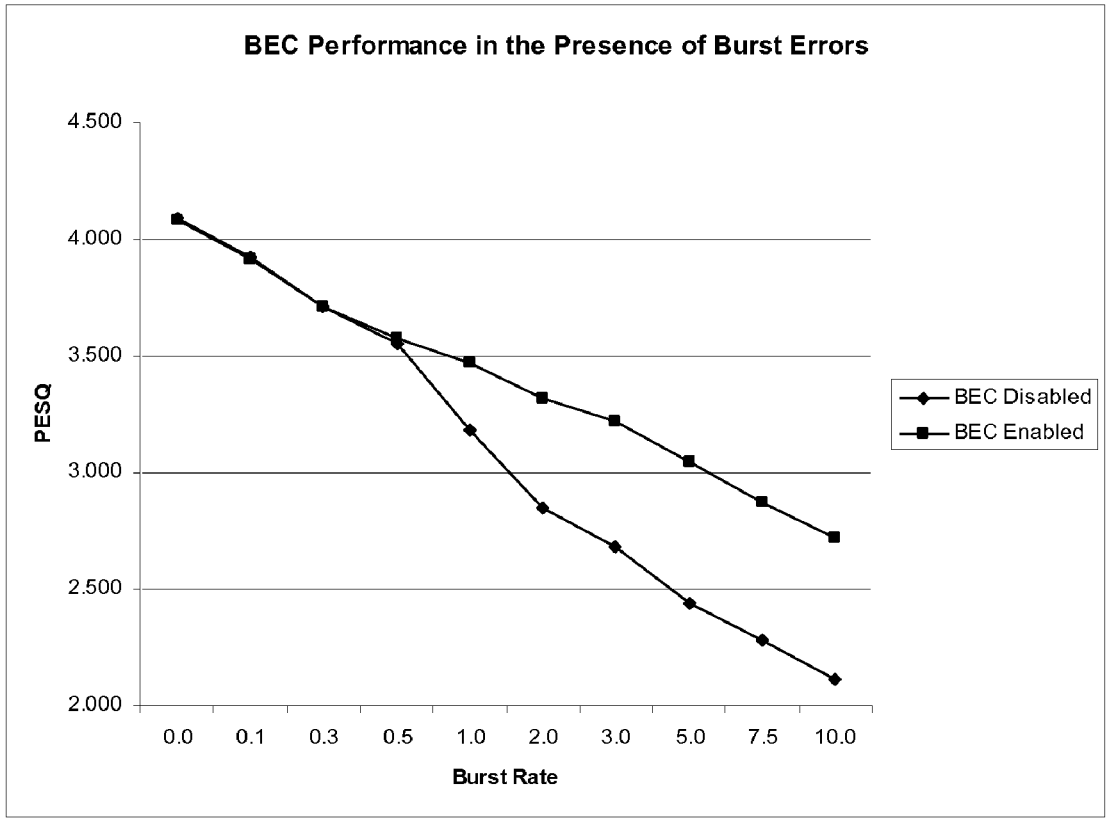
FIG. 6 is a graph depicting the performance of an example BEC system in accordance with an embodiment of the present invention.

IV. Performance of an Example BEC Algorithm in Accordance with an Embodiment of the Present Invention The performance of an example BEC algorithm in accordance with an embodiment of the present invention is illustrated in FIG. 6. As can be seen, this implementation of BEC provides up to 0.6 PESQ (Perceptual Evaluation of Speech Quality) improvement in the presence of bursty bit errors which is a very significant improvement in quality. Alternatively, an implementation of BEC provides 2.0% unprotected quality at 7.5% burst error rates, and 3.0% unprotected quality at 10.0% bursty bit-error rates.

V. Example Computer System Implementation

Depending upon the implementation, various elements of audio device 100 and BEC system 110 (described above in reference to FIGS. 1-4) as well as various steps described above in reference to flowchart 500 of FIG. 5 may be implemented in hardware using analog and/or digital circuits, in software, through the execution of instructions by one or more general purpose or special-purpose processors, or as a combination of hardware and software. An example of a computer system 700 that may be used to execute certain software-implemented features of these systems and methods is depicted in FIG. 7.

Figure 7:
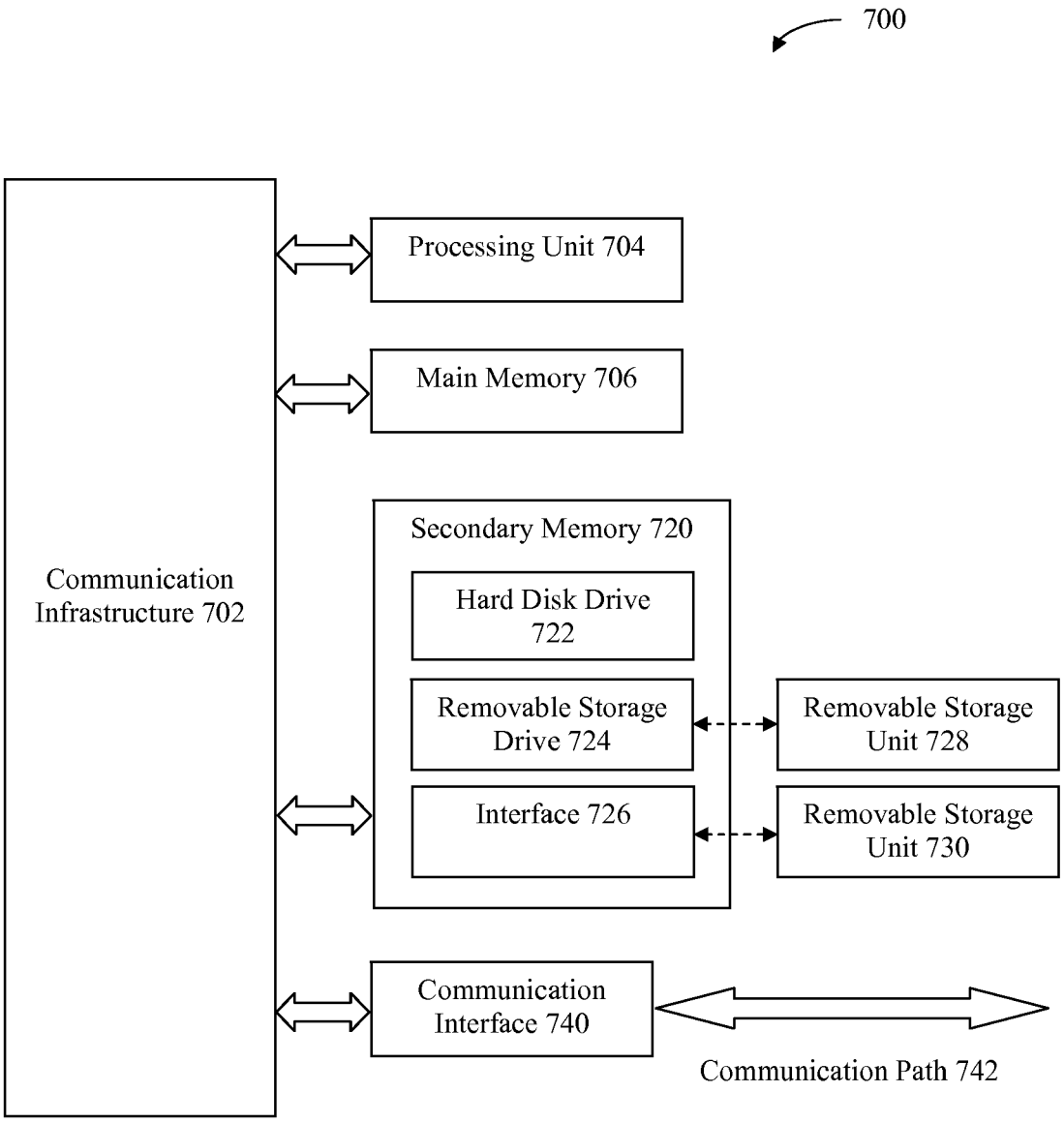
FIG. 7 depicts an example computer system that may be used to implement features of the present invention.

As shown in FIG. 7, computer system 700 includes a processing unit 704 that includes one or more processors. Processor unit 704 is connected to a communication infrastructure 702, which may comprise, for example, a bus or a network.

Computer system 700 also includes a main memory 706, preferably random access memory (RAM), and may also include a secondary memory 720. Secondary memory 720 may include, for example, a hard disk drive 722, a removable storage drive 724, and/or a memory stick. Removable storage drive 724 may comprise a floppy disk drive, a magnetic tape drive, an optical disk drive, a flash memory, or the like. Removable storage drive 724 reads from and/or writes to a removable storage unit 728 in a well-known manner. Removable storage unit 728 may comprise a floppy disk, magnetic tape, optical disk, or the like, which is read by and written to by removable storage drive 724. As will be appreciated by persons skilled in the relevant art(s), removable storage unit 728 includes a computer usable storage medium having stored therein computer software and/or data.

In alternative implementations, secondary memory 720 may include other similar means for allowing computer programs or other instructions to be loaded into computer system 700. Such means may include, for example, a removable storage unit 730 and an interface 726. Examples of such means may include a program cartridge and cartridge interface (such as that found in video game devices), a removable memory chip (such as an EPROM, or PROM) and associated socket, and other removable storage units 730 and interfaces 726 which allow software and data to be transferred from the removable storage unit 730 to computer system 700.

Computer system 700 may also include a communication interface 740. Communication interface 740 allows software and data to be transferred between computer system 700 and external devices. Examples of communication interface 740 may include a modem, a network interface (such as an Ethernet card), a communications port, a PCMCIA slot and card, or the like. Software and data transferred via communication interface 740 are in the form of signals which may be electronic, electromagnetic, optical, or other signals capable of being received by communication interface 740. These signals are provided to communication interface 740 via a communication path 742. Communications path 742 carries signals and may be implemented using wire or cable, fiber optics, a phone line, a cellular phone link, an RF link and other communications channels.

As used herein, the terms "computer program medium" and "computer readable medium" are used to generally refer to media such as removable storage unit 728, removable storage unit 730 and a hard disk installed in hard disk drive 722. Computer program medium and computer readable medium can also refer to memories, such as main memory 706 and secondary memory 720, which can be semiconductor devices (e.g., DRAMs, etc.). These computer program products are means for providing software to computer system 700.

Computer programs (also called computer control logic, programming logic, or logic) are stored in main memory 706 and/or secondary memory 720. Computer programs may also be received via communication interface 740. Such computer programs, when executed, enable computer system 700 to implement features of the present invention as discussed herein. Accordingly, such computer programs represent controllers of computer system 700. Where the invention is implemented using software, the software may be stored in a computer program product and loaded into computer system 700 using removable storage drive 724, interface 726, or communication interface 740.

The invention is also directed to computer program products comprising software stored on any computer readable medium. Such software, when executed in one or more data processing devices, causes a data processing device(s) to operate as described herein. Embodiments of the present invention employ any computer readable medium, known now or in the future. Examples of computer readable mediums include, but are not limited to, primary storage devices (e.g., any type of random access memory) and secondary storage devices (e.g., hard drives, floppy disks, CD ROMS, zip disks, tapes, magnetic storage devices, optical storage devices, MEMs, nanotechnology-based storage device, etc.).

VI. Conclusion

While various embodiments of the present invention have been described above, it should be understood that they have been presented by way of example only, and not limitation. It will be understood by those skilled in the relevant art(s) that various changes in form and details may be made to the embodiments of the present invention described herein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A method for performing bit error concealment in an audio receiver, comprising:

decoding a portion of an encoded bit stream to generate a decoded audio frame, wherein the decoded audio frame comprises a portion of a decoded audio signal;

analyzing at least the decoded audio signal to detect whether the decoded audio frame includes a distortion that will be audible during playback thereof, the distortion being due to bit errors in the encoded bit stream, the analyzing including:

determining if a maximum absolute sample value in a segment of a prediction residual that is associated with the decoded audio frame exceeds an average signal level of the prediction residual for the decoded audio frame multiplied by an adaptive threshold; and responsive to detecting that the decoded audio frame includes the distortion, performing operations on the decoded audio signal to conceal the distortion.

2. The method of claim 1, wherein the step of decoding the portion of the encoded bit stream is performed by one of:

a Continuously Variable Slope Delta Modulation (CVSD) decoder;

a pulse code modulation (PCM) decoder;

a G.711 decoder; or a sub-band codec (SBC) decoder.

3. The method of claim 1 further comprising:

obtaining the prediction residual by performing short term prediction and long term prediction.

4. The method of claim 1, further comprising:

determining the average signal level of the prediction residual for the decoded audio frame by computing an average magnitude of the prediction residual for the decoded audio frame.

5. The method of claim 1, further comprising:

determining the average signal level of the prediction residual for the decoded audio frame by computing an energy level of the prediction residual for the decoded audio frame.

6. A method for performing bit error concealment in an audio receiver, comprising:

decoding a portion of an encoded bit stream to generate a decoded audio frame, wherein the decoded audio frame comprises a portion of a decoded audio signal;

analyzing at least the decoded audio signal to detect whether the decoded audio frame includes a distortion that will be audible during playback thereof, the distortion being due to bit errors in the encoded bit stream, the analyzing including:

analyzing a pitch history of the decoded audio signal;

assigning the pitch history to one of a plurality of pitch track categories based on the analysis; and modifying a sensitivity level for detecting whether the decoded audio frame includes the distortion based on the pitch track category assigned to the pitch history; and responsive to detecting that the decoded audio frame includes the distortion, performing operations on the decoded audio signal to conceal the distortion.

7. A method for performing bit error concealment in an audio receiver, comprising:

decoding a portion of an encoded bit stream to generate a decoded audio frame, wherein the decoded audio frame comprises a portion of a decoded audio signal;

analyzing at least the decoded audio signal to detect whether the decoded audio frame includes a distortion that will be audible during playback thereof, the distortion being due to bit errors in the encoded bit stream, the analyzing including:

computing a plurality of pitch predictor taps associated with the decoded audio frame; and modifying a sensitivity level for detecting whether the decoded audio frame includes the distortion based on a difference between a sum of the plurality of pitch predictor taps associated with the decoded audio frame and a sum of a plurality of pitch predictor taps associated with a previously-decoded audio frame; and responsive to detecting that the decoded audio frame includes the distortion, performing operations on the decoded audio signal to conceal the distortion.

8. A method for performing bit error concealment in an audio receiver, comprising:

decoding a portion of an encoded bit stream to generate a decoded audio frame, wherein the decoded audio frame comprises a portion of a decoded audio signal;

analyzing at least the decoded audio signal to detect whether the decoded audio frame includes a distortion that will be audible during playback thereof, the distortion being due to bit errors in the encoded bit stream, the analyzing including:

calculating a voicing strength measure associated with the decoded audio frame; and modifying a sensitivity level for detecting whether the decoded audio frame includes the distortion based on the voicing strength measure; and responsive to detecting that the decoded audio frame includes the distortion, performing operations on the decoded audio signal to conceal the distortion.

9. The method of claim 1, wherein performing operations on the decoded audio signal to conceal the distortion comprises replacing the decoded audio frame with a synthesized audio frame generated in accordance with a packet loss concealment algorithm.

10. The method of claim 9, further comprising:

performing a state memory update of an audio decoder based on re-encoding of the synthesized audio frame responsive to at least detecting that the decoded audio frame includes the distortion.

11. The method of claim 10, further comprising performing the state memory update of the audio decoder based on re-encoding of the synthesized audio frame responsive to detecting that the decoded audio frame includes the distortion and determining that the decoded audio signal represents background noise.

12. A method for performing bit error concealment in an audio receiver, comprising:

decoding a portion of an encoded bit stream to generate a decoded audio frame, wherein the decoded audio frame comprises a portion of a decoded audio signal;

analyzing at least the decoded audio signal to detect whether the decoded audio frame includes a distortion that will be audible during playback thereof, the distortion being due to bit errors in the encoded bit stream;

responsive to detecting that the decoded audio frame includes the distortion, performing operations on the decoded audio signal to conceal the distortion;

analyzing non-speech segments of the decoded audio signal to estimate a rate at which audible distortions are detected; and adapting a biasing factor based on the estimated rate, wherein the biasing factor is used to determine a sensitivity level for detecting whether the decoded audio frame includes the distortion.

13. The method of claim 12, wherein analyzing non-speech segments of the decoded audio signal to estimate a rate at which audible distortions are detected includes:

limiting the estimated rate to a function of a received packet loss rate.

14. A method for performing bit error concealment in an audio receiver, comprising:

decoding a portion of an encoded bit stream to generate a decoded audio frame, wherein the decoded audio frame comprises a portion of a decoded audio signal;

analyzing at least the decoded audio signal to detect whether the decoded audio frame includes a distortion that will be audible during playback thereof, the distortion being due to bit errors in the encoded bit stream;

responsive to detecting that the decoded audio frame includes the distortion, performing operations on the decoded audio signal to conceal the distortion;

analyzing non-speech segments of the decoded audio signal to estimate a rate at which audible distortions are detected;

determining whether the estimated rate is below a predefined threshold; and responsive to determining that the estimated rate is below the predefined threshold, disabling at least a component configured to perform the analysis of the decoded audio signal to detect whether the decoded audio frame includes the distortion.

15. A system, comprising:

an audio decoder configured to decode a portion of an encoded bit stream to generate a decoded audio frame, wherein the decoded audio frame comprises a portion of a decoded audio signal;

a bit error detection module configured to analyze at least the decoded audio signal to detect whether the decoded audio frame includes a distortion that will be audible during playback thereof, the distortion being due to bit errors in the encoded bit stream, the bit error detection module being configured to perform the analysis by determining if a maximum absolute sample value in a segment of a prediction residual that is associated with the decoded audio frame exceeds an average signal level of the prediction residual for the decoded audio frame multiplied by an adaptive threshold; and a concealment module configured to perform operations on the decoded audio signal to conceal the distortion responsive to detection of the distortion within the decoded audio frame.

16. The system of claim 15, wherein the audio decoder comprises one of:

a Continuously Variable Slope Delta Modulation (CVSD) decoder;

a pulse code modulation (PCM) decoder;

a G.711 decoder; or a sub-band codec (SBC) decoder.

17. The system of claim 15, wherein the bit error detection module is configured to determine the average signal level of the prediction residual for the decoded audio frame by computing an average magnitude of the prediction residual for the decoded audio frame.

18. The system of claim 15, wherein the bit error detection module is configured to determine the average signal level of the prediction residual for the decoded audio frame by computing an energy level of the prediction residual for the decoded audio frame.

19. A system, comprising:

an audio decoder configured to decode a portion of an encoded bit stream to generate a decoded audio frame, wherein the decoded audio frame comprises a portion of a decoded audio signal;

a bit error detection module configured to analyze at least the decoded audio signal to detect whether the decoded audio frame includes a distortion that will be audible during playback thereof, the distortion being due to bit errors in the encoded bit stream, the bit error detection module being configured to perform the analysis by analyzing a pitch history of the decoded audio signal, assigning the pitch history to one of a plurality of pitch track categories based on the analysis, and modifying a sensitivity level for detecting whether the decoded audio frame includes the distortion based on the pitch track category assigned to the pitch history; and a concealment module configured to perform operations on the decoded audio signal to conceal the distortion responsive to detection of the distortion within the decoded audio frame.

20. A system, comprising:

an audio decoder configured to decode a portion of an encoded bit stream to generate a decoded audio frame, wherein the decoded audio frame comprises a portion of a decoded audio signal;

a bit error detection module configured to analyze at least the decoded audio signal to detect whether the decoded audio frame includes a distortion that will be audible during playback thereof, the distortion being due to bit errors in the encoded bit stream, the bit error detection module being configured to perform the analysis by computing a plurality of pitch predictor taps associated with the decoded audio frame and modifying a sensitivity level for detecting whether the decoded audio frame includes the distortion based on a difference between a sum of the plurality of pitch predictor taps associated with the decoded audio frame and a sum of a plurality of pitch predictor taps associated with a previously-decoded audio frame; and a concealment module configured to perform operations on the decoded audio signal to conceal the distortion responsive to detection of the distortion within the decoded audio frame.

21. A system, comprising:

an audio decoder configured to decode a portion of an encoded bit stream to generate a decoded audio frame, wherein the decoded audio frame comprises a portion of a decoded audio signal;

a bit error detection module configured to analyze at least the decoded audio signal to detect whether the decoded audio frame includes a distortion that will be audible during playback thereof, the distortion being due to bit errors in the encoded bit stream, the bit error detection module being configured to perform the analysis by calculating a voicing strength measure associated with the decoded audio frame and modifying a sensitivity level for detecting whether the decoded audio frame includes the distortion based on the voicing strength measure; and a concealment module configured to perform operations on the decoded audio signal to conceal the distortion responsive to detection of the distortion within the decoded audio frame.

22. The system of claim 15, wherein the concealment module is configured to perform operations on the decoded audio signal to conceal the distortion by replacing the decoded audio frame with a synthesized audio frame generated in accordance with a packet loss concealment algorithm.

23. The system of claim 22, further comprising:

a re-encoding module configured to perform a state memory update of the audio decoder based on re-encoding of the synthesized audio frame responsive to at least detection of the distortion within the decoded audio frame.

24. The system of claim 23, wherein the re-encoding module is configured to perform the state memory update of the audio decoder based on re-encoding of the synthesized audio frame responsive to at least detection of the distortion within the decoded audio frame and to determining that the decoded audio signal represents background noise.

25. A system, comprising:

an audio decoder configured to decode a portion of an encoded bit stream to generate a decoded audio frame, wherein the decoded audio frame comprises a portion of a decoded audio signal;

a bit error detection module configured to analyze at least the decoded audio signal to detect whether the decoded audio frame includes a distortion that will be audible during playback thereof, the distortion being due to bit errors in the encoded bit stream;

a concealment module configured to perform operations on the decoded audio signal to conceal the distortion responsive to detection of the distortion within the decoded audio frame; and a threshold biasing module configured to analyze non-speech segments of the decoded audio signal to estimate a rate at which audible distortions are detected and to adapt a biasing factor based on the estimated rate, wherein the biasing factor is used by the bit error detection module to determine a sensitivity level for detecting whether the decoded audio frame includes the distortion.

26. The system of claim 25, wherein the threshold biasing module is configured to estimate the rate at which audible distortions are detected by limiting the estimated rate to a function of a received packet loss rate.

27. A system, comprising:

an audio decoder configured to decode a portion of an encoded bit stream to generate a decoded audio frame, wherein the decoded audio frame comprises a portion of a decoded audio signal;

a bit error detection module configured to analyze at least the decoded audio signal to detect whether the decoded audio frame includes a distortion that will be audible during playback thereof, the distortion being due to bit errors in the encoded bit stream;

a concealment module configured to perform operations on the decoded audio signal to conceal the distortion responsive to detection of the distortion within the decoded audio frame; and a threshold biasing module configured to analyze non-speech segments of the decoded audio signal to estimate a rate at which audible distortions are detected, to determine whether the estimated rate is below a predefined threshold and to disable at least the bit error detection module responsive to determining that the estimated rate is below the predefined threshold.

28. A computer program product comprising a computer-readable medium having computer program logic recorded thereon for enabling a processing unit to perform bit error concealment, the computer program logic comprising:

first means for enabling the processing unit to decode a portion of an encoded bit stream to generate a decoded audio frame, wherein the decoded audio frame comprises a portion of a decoded audio signal;

second means for enabling the processing unit to analyze at least the decoded audio signal to detect whether the decoded audio frame includes a distortion that will be audible during playback thereof, the distortion being due to bit errors in the encoded bit stream, the analyzing including determining if a maximum absolute sample value in a segment of a prediction residual that is associated with the decoded audio frame exceeds an average signal level of the prediction residual for the decoded audio frame multiplied by an adaptive threshold; and third means for enabling the processing unit to perform operations on the decoded audio signal to conceal the distortion responsive to detection of the distortion within the decoded audio frame.

* * * * *